United States Patent [19]

Hansen

[11] Patent Number: 4,776,484

[45] Date of Patent: Oct. 11, 1988

[54] UNITIZED CABINET DESIGN

[75] Inventor: William G. Hansen, Clarksville, Tenn.

[73] Assignee: American Standard Inc., New York, N.Y.

[21] Appl. No.: 901,338

[22] Filed: Aug. 28, 1986

[51] Int. Cl.[4] ..... E06B 3/46

[52] U.S. Cl. ..... 220/345; 220/346; 220/4 R; 220/84; 49/463

[58] Field of Search ..... 220/84, 4 F, 4 R, 452, 220/431, 432, 468, 291, 345, 346; 49/463, 466

[56] References Cited

U.S. PATENT DOCUMENTS 3,636,661 1/1972 Strawsine ..... 49/463

*Primary Examiner*—Stephen Marcus
*Assistant Examiner*—Nova Stucker
*Attorney, Agent, or Firm*—William J. Beres; Robert J. Harter; Carl M. Lewis

[57] ABSTRACT

A frameless air handling enclosure is made possible by the use of double-flanged edges on the enclosure's side and bottom panels. The edge configuration provides reinforcement and rigidity to an otherwise flexible panel and also provides a mating surface for fastening the panels together. The enclosure includes an access opening that is covered by a removable access panel having a lining of sound and thermal insulating material. The access panel is installed by first sliding it upward into engagement with a top flange retainer and then sliding it back down into engagement with a bottom flange retainer. Upon engagement with both flange retainers, the lining of insulation is compressed against the perimeter of the access opening. This compression fit not only helps hold the access panel firmly in place but also provides a weathertight seal around the perimeter of the opening.

10 Claims, 4 Drawing Sheets

UNITIZED CABINET DESIGN

TECHNICAL FIELD

This invention generally pertains to enclosures for large air handling equipment and specifically to a frameless enclosure with a slide-in access panel.

BACKGROUND OF THE INVENTION

Large air handling equipment such as fans, heat exchangers, and air conditioners for industrial and commercial buildings are often installed either on the roof of the building, or at ground level along the side of the building. The equipment is typically sheltered within an insulated enclosure for protection against weather and for sound dampening purposes.

Typically, the relatively large enclosures comprise several sheet metal side panels, a top cover, and a bottom panel, all mounted to a sturdy frame for support. Access to the interior of the enclosure is often by means of an access opening through one of the side panels. The opening is covered by an access panel and is reinforced with a sturdy fabricated frame to enable the access panel to be hinged and latched to the frame.

Such enclosures have several disadvantages. For example, gaskets are needed to seal the numerous joints between components of the enclosure. In addition, small moving parts such as hinges and latches on the access door are susceptible to failure due to corrosion. Another drawback is the need for a main support frame which is fairly expensive to manufacture because it is a relatively large structure constructed of heavy gauge sheet metal.

Therefore, it is an object of this invention to provide an enclosure for large air handling equipment which does not require a prefabricated frame.

Another object is to reduce the number of gaskets by having the sound and thermal insulating material also function as a gasket.

Another object is to provide an access panel that is secured with fasteners having no moving parts.

Another object is to provide an access opening which does not require a fabricated frame for rigidity.

Another object is to provide a vertical panel that can be easily adapted to function either as a bottom panel or a dividing panel.

Another object is to provide sheet metal enclosure panels having edges that can be joined in a variety of configurations.

These and other objects of the invention will be more fully understood after consideration of the following description of the preferred embodiments and the accompanying drawings.

SUMMARY OF THE INVENTION

An air handling enclosure is constructed of a plurality of interconnected, self-supporting panels. A double-flange having an L-shaped cross section is integrally formed along the perimeter of each panel. One leg of the flange extends perpendicular to and the other leg extends substantially parallel to the face of the panel.

At least one of the panels is adapted to include an access opening located between two flange retainers and defined by a frame integrally formed into the face of the panel. The access opening is covered by a removable access panel that is held in place by first sliding the access panel in one direction into sliding engagement with one flange retainer, and then sliding it back in an opposite direction into sliding engagement with another flange retainer.

DESCRIPTION OF THE PREFERRED EMBODIMENTS

Figure 1:
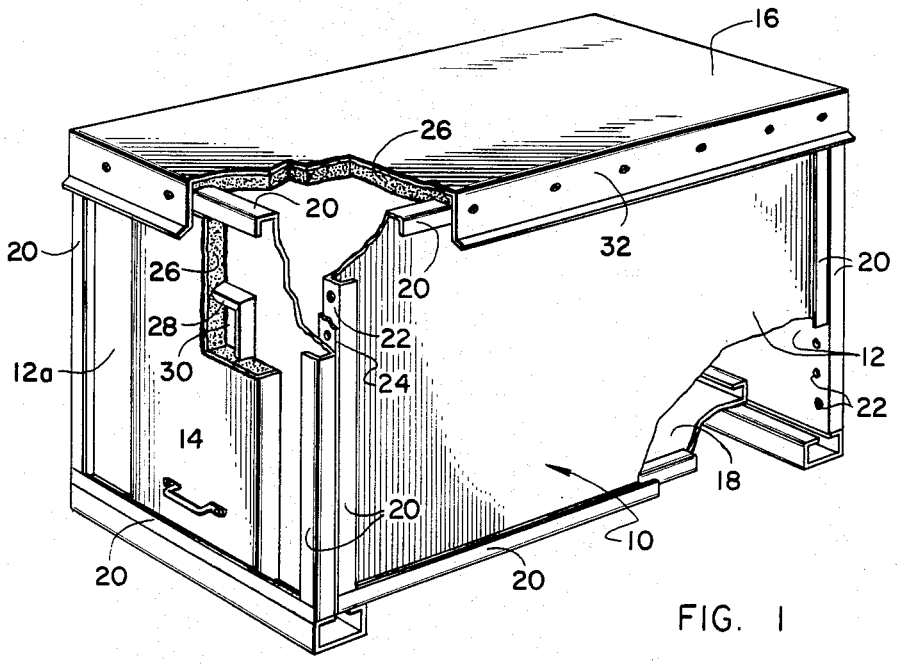
FIG. 1 is a cutaway perspective view of the enclosure.

The subject invention shown in FIG. 1 is a frameless enclosure generally denoted by reference numeral 10, for use with large air handling equipment. Enclosure 10 includes side panels 12 and 12*a*, access panel 14, top cover 16, and bottom panel 18.

Each enclosure panel 12, 12*a* and 18 is made of sheet metal and is formed to integrally include double-flanges 20 around its perimeter. Flanges 20 provide rigidity as well as define edges that are adapted to join panels 12, 12*a* and 18. These panels are held together with fasteners 22 and weather sealed with gasket 24. Fasteners 22 may be bolts, sheet metal screws, self-tapping screws, rivets or any other appropriate device. Along the top of each panel 12 and 12*a*, double-flange 20 provides a wide flat edge upon which insulation 26 disposed under cover 16 may rest without being cut, as might occur if the edge were narrow. The weight of cover 16 compresses insulation 26 against double-flange 20 to provide a weathertight seal between cover 16 and side panels 12 and 12*a*. It should be noted that insulation 26 can be selected from a variety of resilient insulating materials, such as glass wool, foam rubber, or a dual density insulation, such as "TUF-SKIN" which is a registered trademark of the Johns-Manville Corporation for a blanket-type insulation made of fine borosilicate glass fibers bonded with a thermosetting resin.

As double-flanges 20 are formed along the perimeter of side panel 12*a* a piercing and forming operation is included to provide an integral lip 28 which defines access opening 30. Opening 30 is covered by removable access panel 14 which has a flanged edge for rigidity and a lining of insulation 26 used not only for noise dampening and thermal insulation, but also to help hold access panel 14 in place and to provide a weathertight seal.

Figure 2:
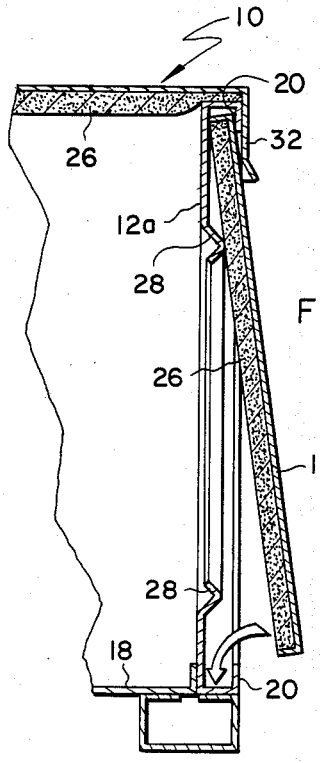
FIGS. 2 and 3 show how an access panel is installed over an access opening in the enclosure.
Figure 3:
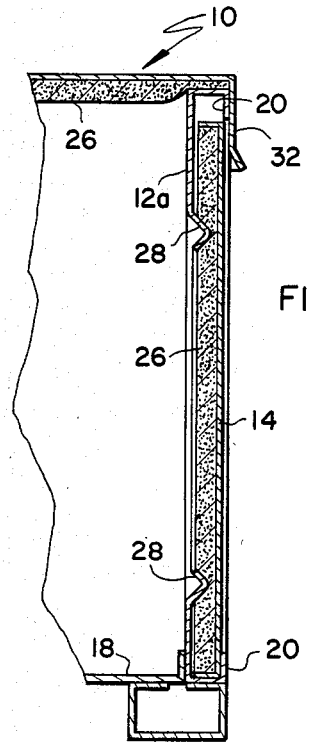

Access panel 14 is easily installed as shown in FIGS. 2 and 3. FIG. 2 shows panel 14 being lifted into sliding engagement with the upper flange retainer comprising overhanging flange 32 and upper flange 20. FIG. 3 shows access panel 14 after it has been slid back down into engagement with a lower flange retainer comprising lower double-flange 20 of side panel 12*a*. Integrally formed lip 28, pushing into resilient insulation 26, helps hold access panel 14 in place and in addition, provides a weathertight seal.

Figure 4:
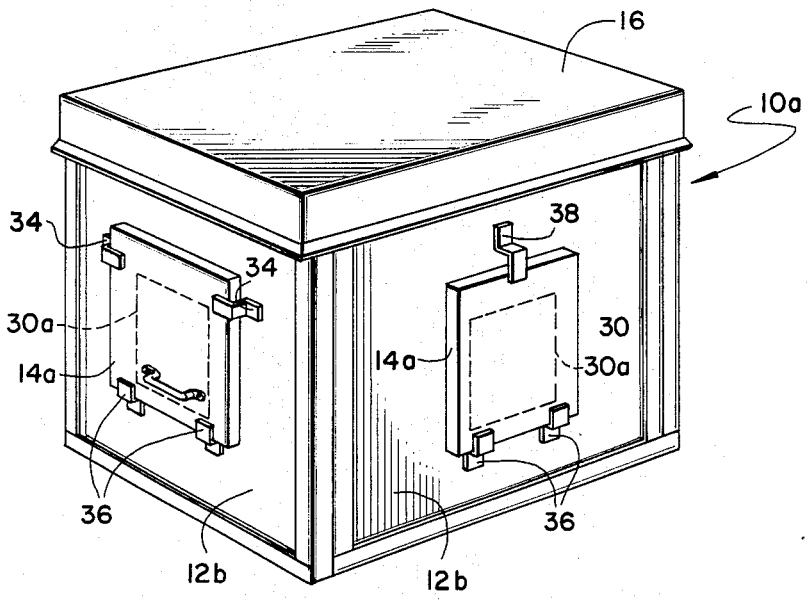
FIG. 4 shows one embodiment of the invention, wherein the height of the access panel is substantially shorter than the height of the enclosure.

Referring to FIG. 4, access panels 14*a* which do not extend the full height of enclosure 10*a* are installed by welding retaining flanges 34, 36, and 38 to side panels 12*b* near access openings 30*a*. The access panel installation procedure is similar to the procedure for installing access panel 14 of FIGS. 2 and 3. Panel 14*a* is first slid upward into sliding engagement with upper flange retainers 34 or 38 and then slid back down into engagement with lower flange retainers 36.

Figure 5:
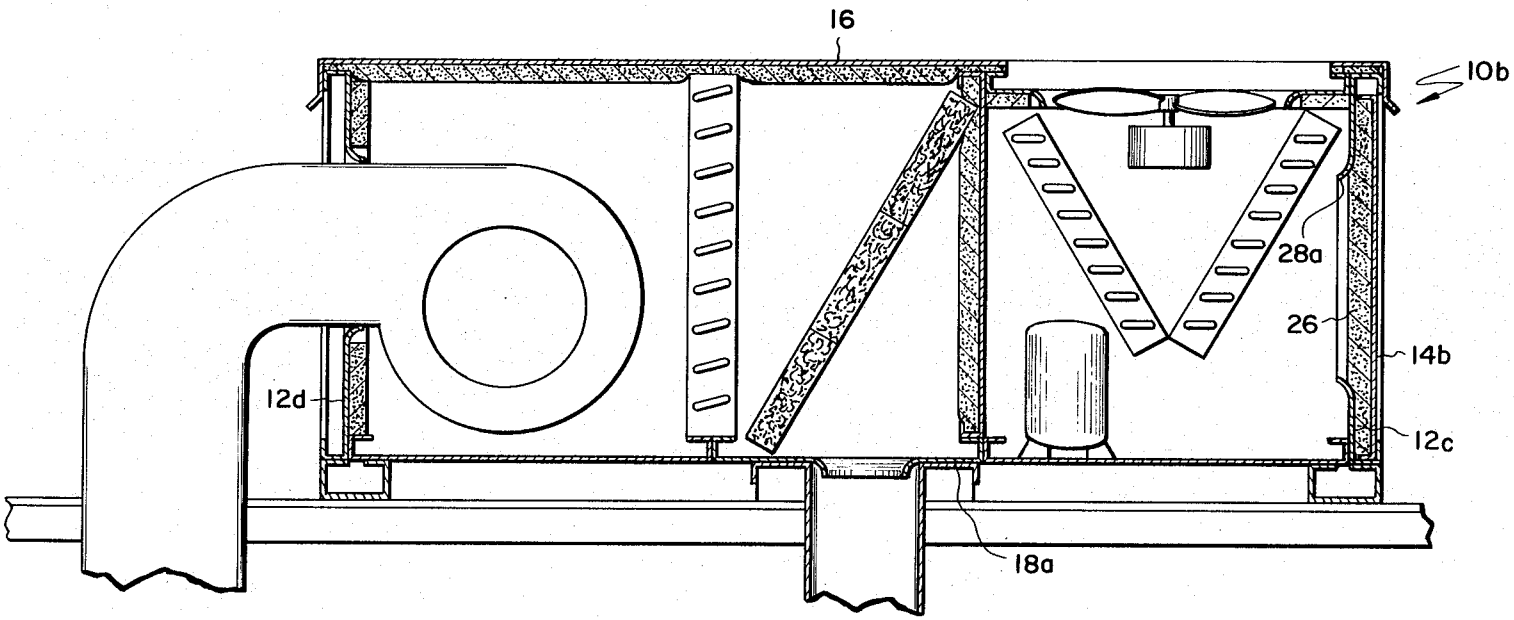
FIG. 5 is a cross sectional view of another embodiment of the enclosure.

Side panel 12*c*, shown in FIG. 5, is pierced and formed to provide an access opening and can also be used as a panel having an air duct opening, as in side panel 12*d* and bottom panel 18*a*.

Also shown in FIG. 5 is insulation 26 used to line side panel 12*d* and top cover 16. The insulation lining top cover 16 is compressed against the top of side panels 12*c* and 12*d*. In addition, lip 28*a*, formed around the access opening and extending into the interior of an enclosure 10*b*, compresses insulation 26 on access panel 14*b*, thereby providing a weathertight seal.

Figure 6:
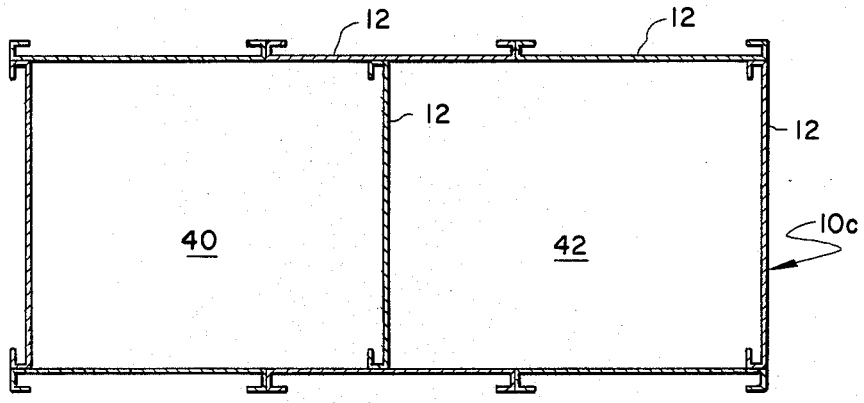
FIG. 6 is a top view schematic diagram illustrating how the side panels are interconnected to form a larger enclosure.

FIG. 6 illustrates a schematic top view of a plurality of side panels 12 interconnected end-to-end to comprise one large side panel which are then combined to form a large enclosure 10*c*. Depending on the requirements of the enclosed air handling equipment, enclosure 10*c* can be divided by a side panel 12 into two or more compartments 40 and 42.

Figure 7:
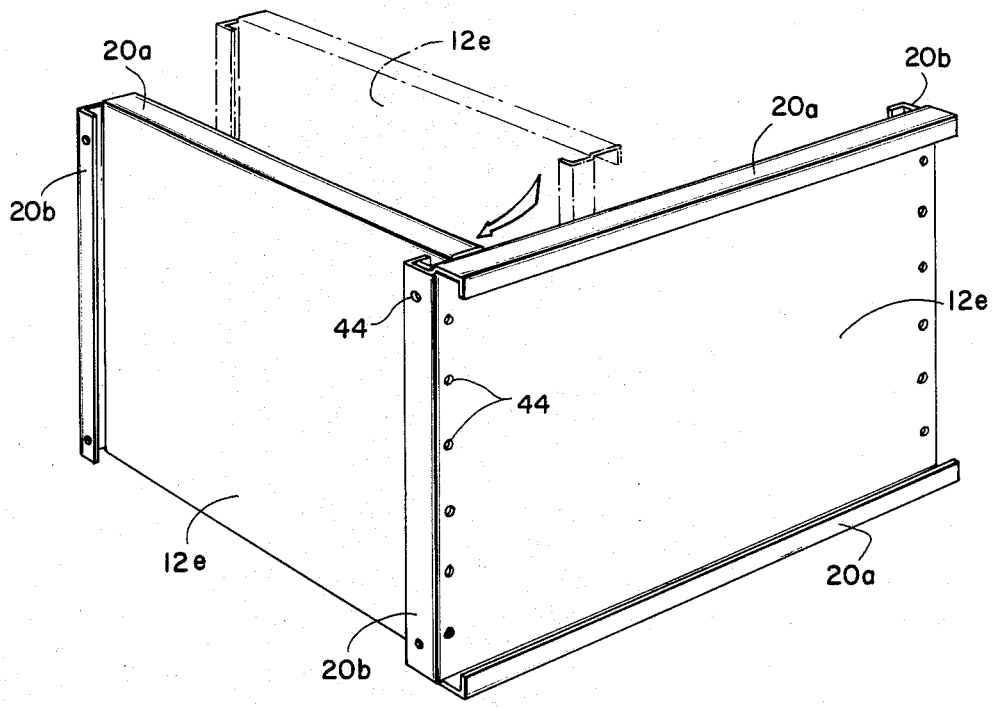
FIG. 7 is a perspective view of another embodiment showing how two side panels are joined to create a labyrinth seal.
Figure 8:
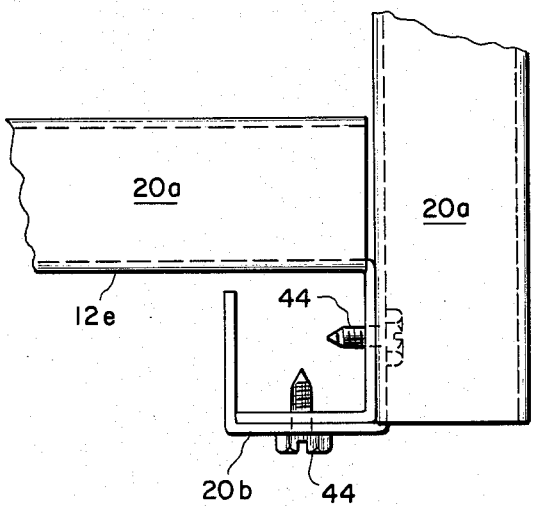
FIG. 8 is a top view of the labyrinth seal.

In another embodiment, shown in FIGS. 7 and 8, upper and lower double-flanges 20*a* extend from the face of side panel 12*e* in a direction opposite that of the other two flanges 20*b*. The assembled joint provides a labyrinth seal which can reduce or eliminate the need for gasket 24 between the joint, especially when washer-shaped gaskets (not shown) are used under the heads of fasteners 44. Appropriate fasteners for this joint are those which can be installed with access to only one side of the pieces to be joined. Examples of fasteners 44 are sheet metal screws, self-tapping screws, and pop-rivets.

Although the invention is described with respect to several preferred embodiments, modifications thereto will be apparent to those skilled in the art. Therefore, the scope of the invention is not limited by the preceding disclosure, and is to be determined solely by reference to the claims which follow.

I claim:

1. An enclosure panel having an access opening, comprising an access panel with a length and width greater than the length and width of said access opening; two retaining flanges disposed near said access opening and extending generally parallel to the face of said enclosure panel, said retaining flanges being adapted to secure said access panel over said access opening upon first sliding said access panel in one direction into sliding engagement between said enclosure panel and one of said retaining flanges, and then sliding said access panel back in generally an opposite direction into sliding engagement between said enclosure panel and said other retaining flange; and a lining of insulation resiliently compressed between said enclosure panel and said access panel when said access panel is engaged with said retaining flanges, whereby said insulation provides a weathertight seal and helps hold said access panel in place.

2. The enclosure panel as recited in claim 1, wherein said retaining flanges each have a generally L-shaped cross-section with one leg of the flange extending substantially perpendicular to the face of said enclosure panel and the other leg extending from said one leg both substantially parallel to the face of said enclosure panel and generally over said access panel when said access panel is engaged with said retaining flanges.

3. The enclosure panel as recited in claim 2, wherein said retaining flanges are disposed at generally opposite ends of the access opening and are elongated to run substantially the full width thereof, and wherein the legs of said retaining flanges which extend over said access panel also extend toward each other.

4. An enclosure panel having an access opening, comprising an access panel lined with insulation and having a length and width greater than the length and width of said access opening, and two retaining flanges disposed near said access opening and extending generally parallel to the face of said enclosure panel, said retaining flanges being adapted to secure said access panel over said access opening upon first sliding said access panel in one direction into sliding engagement between said enclosure panel and one of said retaining flanges and then sliding said access panel back in generally an opposite direction into sliding engagement between said enclosure panel and said other retaining flange, said enclosure panel also having a lip that lines the perimeter of said access opening and extends out of coplanar alignment with said enclosure panel.

5. The enclosure panel as recited in claim 4, wherein said lip is integrally formed into said enclosure panel.

6. The enclosure panel as recited in claim 4, wherein said retaining flanges each have a generally L-shaped cross-section with one leg of the flange extending substantially perpendicular to the face of said enclosure panel and the other leg extending from said one leg both substantially parallel to the face of said enclosure panel and generally over said access panel when said access panel is engaged with said retaining flanges.

7. The enclosure panel as recited in claim 6, wherein said retaining flanges are disposed at generally opposite ends of the access opening and are elongated to run substantially the full width thereof, and wherein the legs of said retaining flanges which extend over said access panel also extend toward each other.

8. An enclosure panel having an access opening, comprising:

a. a slip disposed along the perimeter of said access opening and offset out of coplanar alignment with the face of said enclosure panel;

b. an access panel having a length and width greater than the length and width of said access opening;

c. a lining of insulation disposed on one side of said access panel;

d. a first retaining flange, in juxtaposition with said access opening, which includes a first segment extending along a plane that is generally in offset and parallel relationship with said enclosure panel; and e. a second retaining flange, in juxtaposition with said access opening, which includes a second segment extending along a plane that is generally in offset and parallel relationship with said enclosure panel, wherein said insulation on said access panel is compressed against said enclosure panel when said access panel is slid in one direction over said access opening and into sliding engagement between said enclosure panel and said first segment and then slid in generally an opposite direction over said access opening and into sliding engagement between said enclosure panel and said second segment.

9. The enclosure panel as recited in claim 8 wherein said first and second retaining flanges are disposed at generally opposite ends of said access opening and are elongated to run substantially the full width thereof with both retaining flanges in substantially parallel alignment with each other.

10. The enclosure panel as recited in claim 8, wherein said lip is integrally formed into said enclosure panel.

* * * * *

UNITED STATES PATENT AND TRADEMARK OFFICE

CERTIFICATE OF CORRECTION

PATENT NO. : 4,776,484

DATED : October 11, 1988

INVENTOR(S) : William G. Hansen

It is certified that error appears in the above-identified patent and that said Letters Patent is hereby corrected as shown below:

In the Claims:

Claim 8, column 4, line 47 "slip" should be --lip--.

Signed and Sealed this

Seventh Day of March, 1989

*Attest:*

DONALD J. QUIGG

*Attesting Officer*

*Commissioner of Patents and Trademarks*